US007481332B2

(12) United States Patent
Ollmann et al.

(10) Patent No.: US 7,481,332 B2
(45) Date of Patent: Jan. 27, 2009

(54) APPARATUS FOR BLENDING TWO DIFFERENT COMPONENTS

(75) Inventors: Ute Ollmann, Ratzeburg (DE); Rudiger Belau, Bad Oldesloe (DE); Olaf Kersten, Krefeld (DE)

(73) Assignee: Lindal Ventil GmbH, Oldesloe (DE)

( * ) Notice: Subject to any disclaimer, the term of this patent is extended or adjusted under 35 U.S.C. 154(b) by 498 days.

(21) Appl. No.: 11/265,263

(22) Filed: Nov. 1, 2005

(65) Prior Publication Data

US 2006/0114745 A1 Jun. 1, 2006

(30) Foreign Application Priority Data

Nov. 2, 2004 (DE) ..... 10 2004 052 986

(51) Int. Cl.
*B67D 5/52* (2006.01)

(52) U.S. Cl. ..... 222/135; 222/162; 222/402.15

(58) Field of Classification Search ..... 222/135, 222/162, 402.15
See application file for complete search history.

(56) References Cited

U.S. PATENT DOCUMENTS 3,303,970 A * 2/1967 Breslau et al. ..... 222/134
4,880,143 A * 11/1989 Murray et al. ..... 222/135
6,305,578 B1 * 10/2001 Hildebrandt et al. ..... 222/135

* cited by examiner

*Primary Examiner*—Kevin P Shaver
(74) *Attorney, Agent, or Firm*—Vidas, Arrett & Steinkraus, P.A.

(57) ABSTRACT

An apparatus for blending two different components, comprising: two vessels each containing one of said components, connection means to which said components are separately fed from said vessel, and an actuation device which initiates the entry of the components into said connection means from said vessels at a predetermined ratio, where a pressurized vessel each is provided as a vessel from which said component is discharged by means of an expulsion agent via a valve, the valves of said vessels being operated via the actuation device.

22 Claims, 9 Drawing Sheets

APPARATUS FOR BLENDING TWO DIFFERENT COMPONENTS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to an apparatus for blending two different components.

Two-component systems in which two different components are blended with each other for specific purposes have sufficiently been known. For example, it is possible to employ reactive adhesives and sealants for very different applications. Likewise, two-component systems can be used for potting and encapsulating items in the field of electrotechnical equipment.

A known blending apparatus, for example, is designed as a 2-component blending gun in which the materials being blended are provided in two cartridges. The material is forced out of the cartridges into a tubular or tip-shaped mixer via one piston each. A detent mechanism is provided to actuate the blending gun and cause the rams to be advanced by steps in the cartridges. It is also known to provide a pneumatic advancing motion system for the pistons instead of the mechanical detent mechanism.

It is the object of the invention to provide an apparatus for blending two different components which allows to easily handle the components being blended and control the expulsion thereof.

BRIEF SUMMARY OF THE INVENTION

Advantageous aspects define the subject matters of the sub-claims.

The inventive apparatus serves for blending two different components which preferably react with each other to obtain the desired material. The device has two vessels which receive one component each, connection means to which the components are separately fed from the vessel and from which they exit in order to be contacted with each other in a mixer, for example. Further, an actuation device is provided which initiates the entry of the components into the connection means from the vessels at a predetermined ratio. According to the invention, a pressurized vessel each is provided as a vessel from which the components are dispensed by means of an expulsion medium via a valve. In the inventive apparatus, the valves of the vessel are opened and closed via the actuation device.

Unlike in the known 2-component blending gun, a piston is no longer moved directly by the actuation device in the inventive apparatus, but a valve is opened on a pressurized vessel. The components will then exit from the pressurized vessel through the valve and are fed to the connection means and/or passed on to a mixer. A particular advantage of the inventive apparatus is that the components being blended are provided in pressurized vessels from which the components being blended are caused to exit by an expulsion medium in the vessel.

It is preferred that a dispensing vessel is provided as a vessel which is of a substantially cylindrical shape. The dispensing vessels may be arranged as a package in parallel with each other, the vessels preferably being provided with a valve each at their fronts.

In a preferred aspect, at least one of the vessels is provided with a male valve which opens when a pressure acts on its projecting stem in an axial direction and/or which opens when its projecting stem is tilted crosswise to the axial direction. Alternatively, it is possible for at least one of the vessels to have a female valve which opens when under a pressure in an axial direction.

In a preferred aspect, the connection means have a blending body including two inlet openings and two channels. The blending body preferably has provided therein a check valve each in the channel that prevents the components from flowing back to the vessel. This avoids any undesirable reaction between components in the blending body. The connection means further have an insert body which defines the channels, along with the blending body. It is preferred that the connection means are provided with a blending tube in which the components then undergo thorough blending. The blending tube is suitably placed on top of the blending body.

The inventive device has a holder to releasably connect to the vessels. The vessels may be exchanged singly or by pairs for use on the holder. The holder is provided with a handle and an actuation lever. The actuation lever is hinged to the holder and has a projection which interacts with the vessels. It is preferred that the holder has a head portion in which the connection means are disposed.

The vessels can be jointly disposed in a reception sleeve where the sleeve has detent means which grip behind a projection of the vessel. The detent means have a catch plate including two indentations and a lever may additionally be provided to disengage the catch plate from its engaged position.

The reception sleeve further has an abutting surface which interacts with the actuation device. The sleeve can be moved, along with the vessels, within the head portion of the holder to open the valves of the vessels. Force is transmitted to the valve via the connection means here.

As an alternative of the reception sleeve, a pair of vessel attachments may also be used which are placed on the top and bottom portions of the vessels. Each vessel attachment has two receptacles which accommodate the vessel in its top and bottom regions. At least one of the vessel attachments, in the region of the receptacle, has a through opening through which the valve is accessible. If a vessel is used with a male valve the stem will protrude through the through opening. If a female valve is used an extension socket or the like can pass through the through opening and operate the valve in the vessel attachment. For a connection of vessels and vessel attachments, catch lugs are provided which grip behind appropriate projections on said vessels.

As in the case of the reception sleeve, the vessel attachment for the head portion of the vessels has an abutting surface which interacts with the actuation device. Upon actuation, the vessel attachment is advanced along with the vessels and the force expended for the purpose is utilized to open the vessel valves.

BRIEF DESCRIPTION OF THE SEVERAL VIEWS OF THE DRAWINGS

Preferred embodiments of the inventive device will be explained in more detail below.

DETAILED DESCRIPTION OF THE INVENTION

Figure 1:
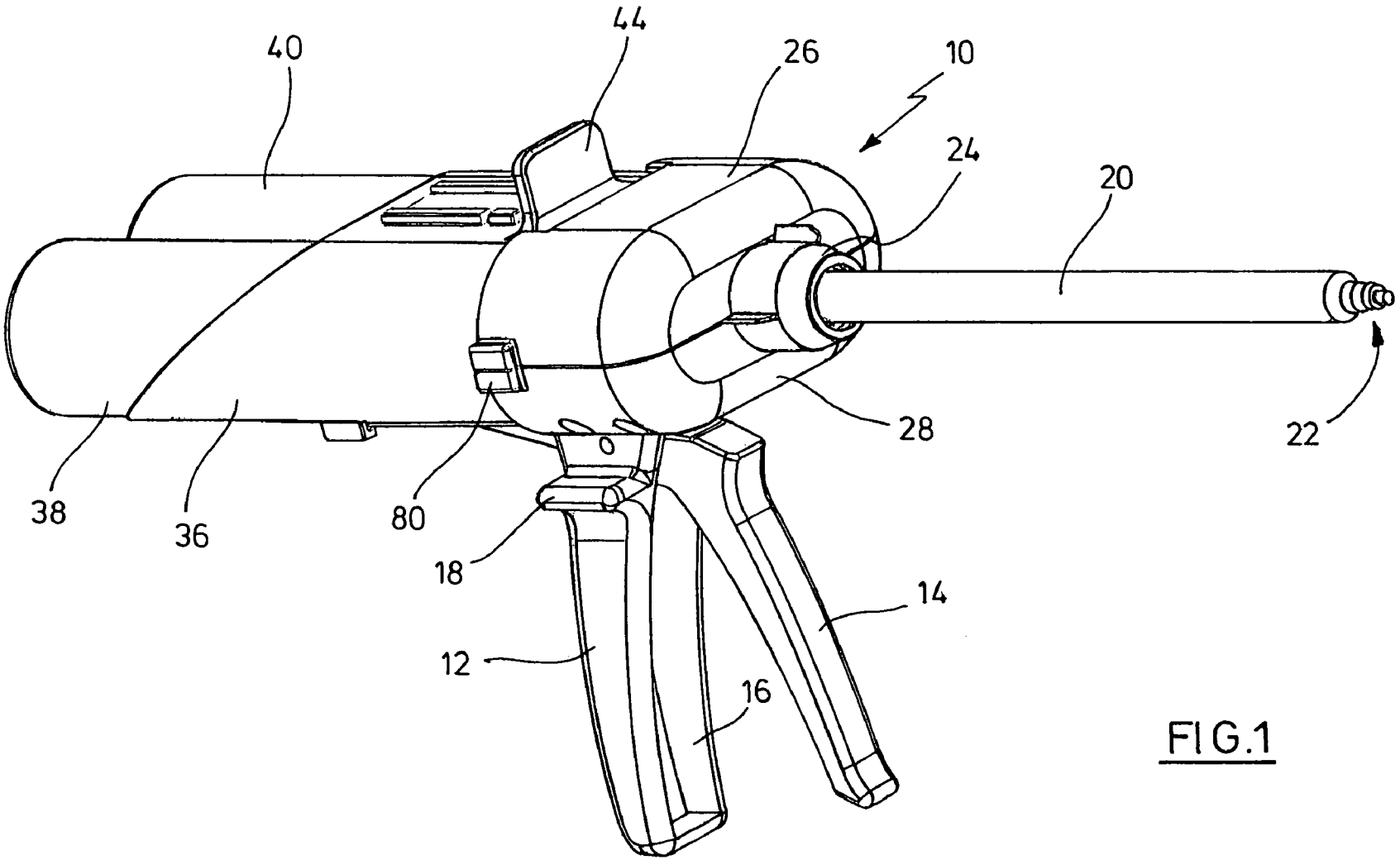
FIG. 1 shows a perspective view of the inventive blending gun as seen obliquely from the front.
Figure 2:
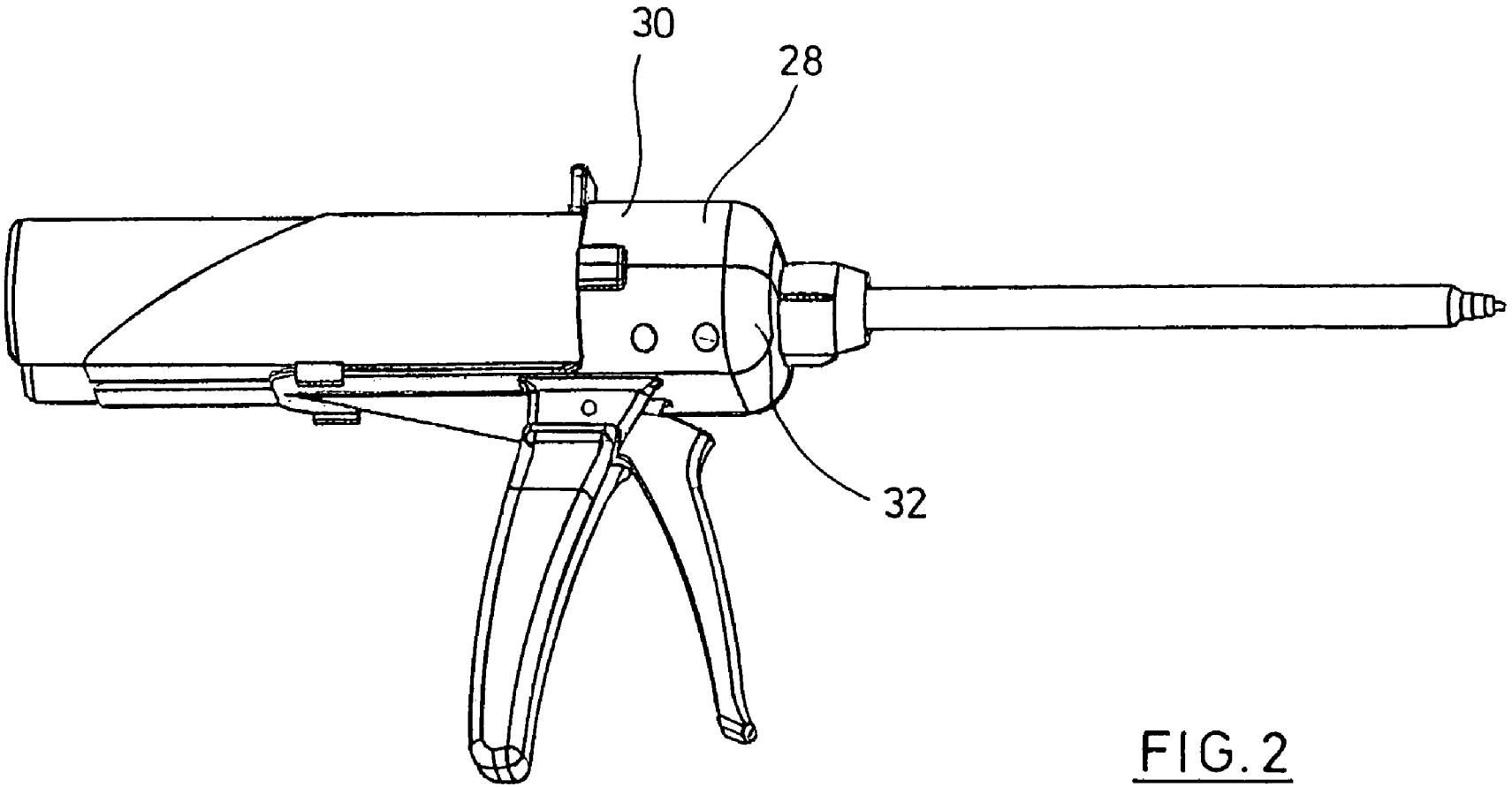
FIG. 2 shows a perspective view of the inventive blending gun as seen from a side.

While this invention may be embodied in many different forms, there are described in detail herein a specific preferred embodiment of the invention. This description is an exemplification of the principles of the invention and is not intended to limit the invention to the particular embodiment illustrated FIG. 1 shows a two-component blending gun 10 in a perspective view. The blending gun 10 has a handle 12 with an actuation lever 14. The handle 12 has a receptacle 16 which receives the actuation lever 14 when in its depressed condition. The handle 12 laterally is further provided with a lug 18 which can serve as an abutment for the thumb during an actuation.

The 2-component blending gun has a mixer 20 which internally exhibits helically shaped blending plates which are known as such and thoroughly blend the components which are advanced by them. The components, when blended together, exit through the mixer tip 22. The mixer 20 is selected in its diameter and its arrangement of the guide plates used in a manner known as such depending on the requirements made to the components being blended. The mixer 20 is screwed to a holder 26 by means of a spigot nut 24. The holder 26 exhibits a head portion 28 which has an upper half 30 and a lower half 32 which is joined to the handle 12. The holder 26 further exhibits a supporting plate 34 through which the actuation lever 14 is extended (cf. FIG. 3). The upper and lower parts of the head portion 28 can be screwed to each other.

Referring back to FIG. 1: The two-component blending gun which is shown further has a sleeve-like vessel receptacle 36 which accommodates two cylindrical dispensing vessels 38, 40. At its end facing the mixer 20, the vessel receptacle 36 has a catch plate 42 which is fixed to a movable tongue 46 of the mounting 36 and can be moved via a lever 44 that stands out (cf. FIG. 3).

For insertion, the dispensing vessels 38 and 40 are axially introduced into the receptacle 36 and are advanced until the catch plate 42 grips behind the valve disks, the rim of the vessel or another lug on the dispensing vessels. The vessels will then be in communication with the vessel receptacle 36. For an exchange of the vessels 38 and 40 after use, the lever 44 is bent away from the mixer 20 to release the cans 38 and 40.

Figure 3:
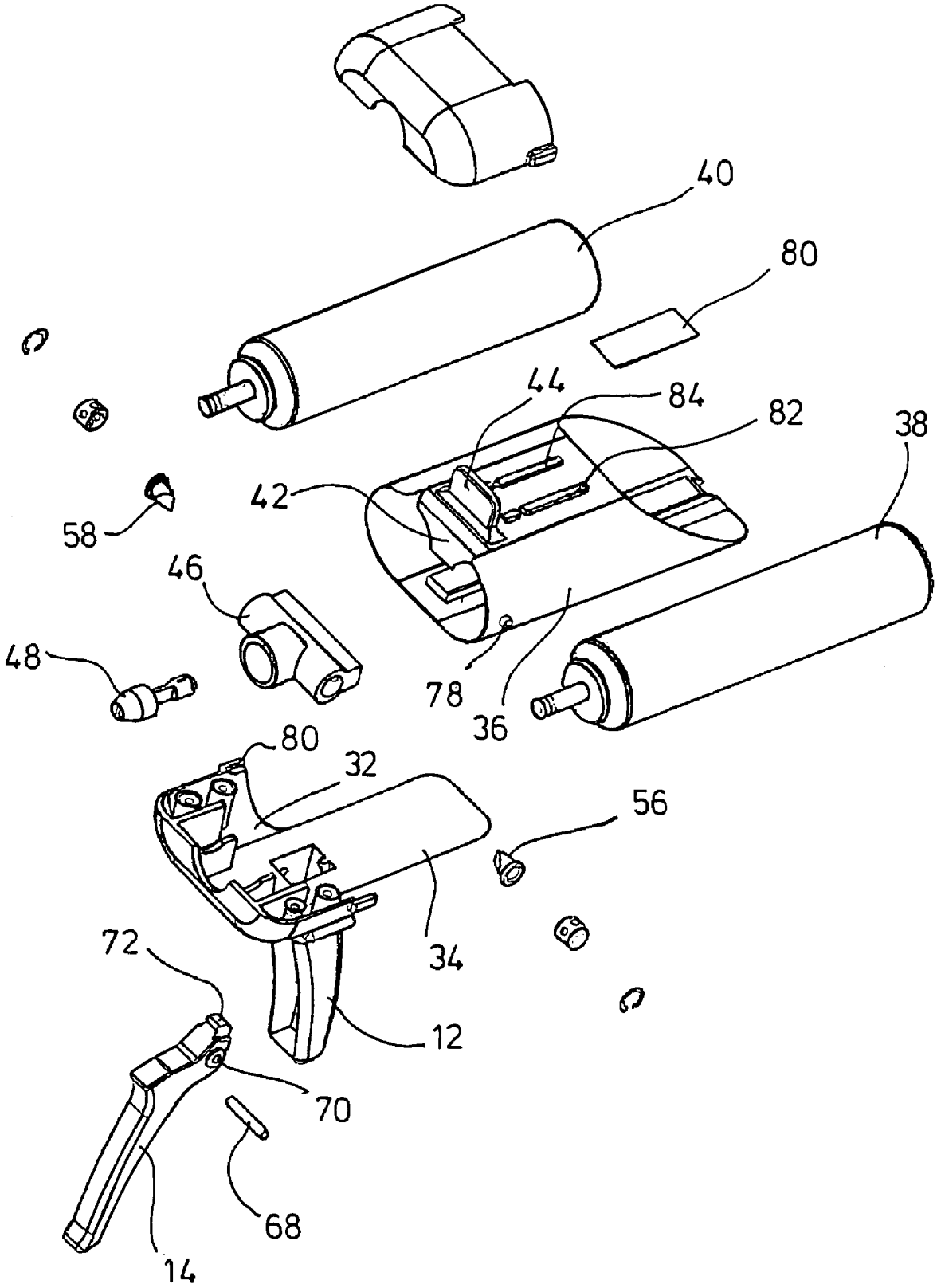
FIG. 3 shows an exploded view of the blending gun of FIG. 1 as seen obliquely from top.
Figure 4:
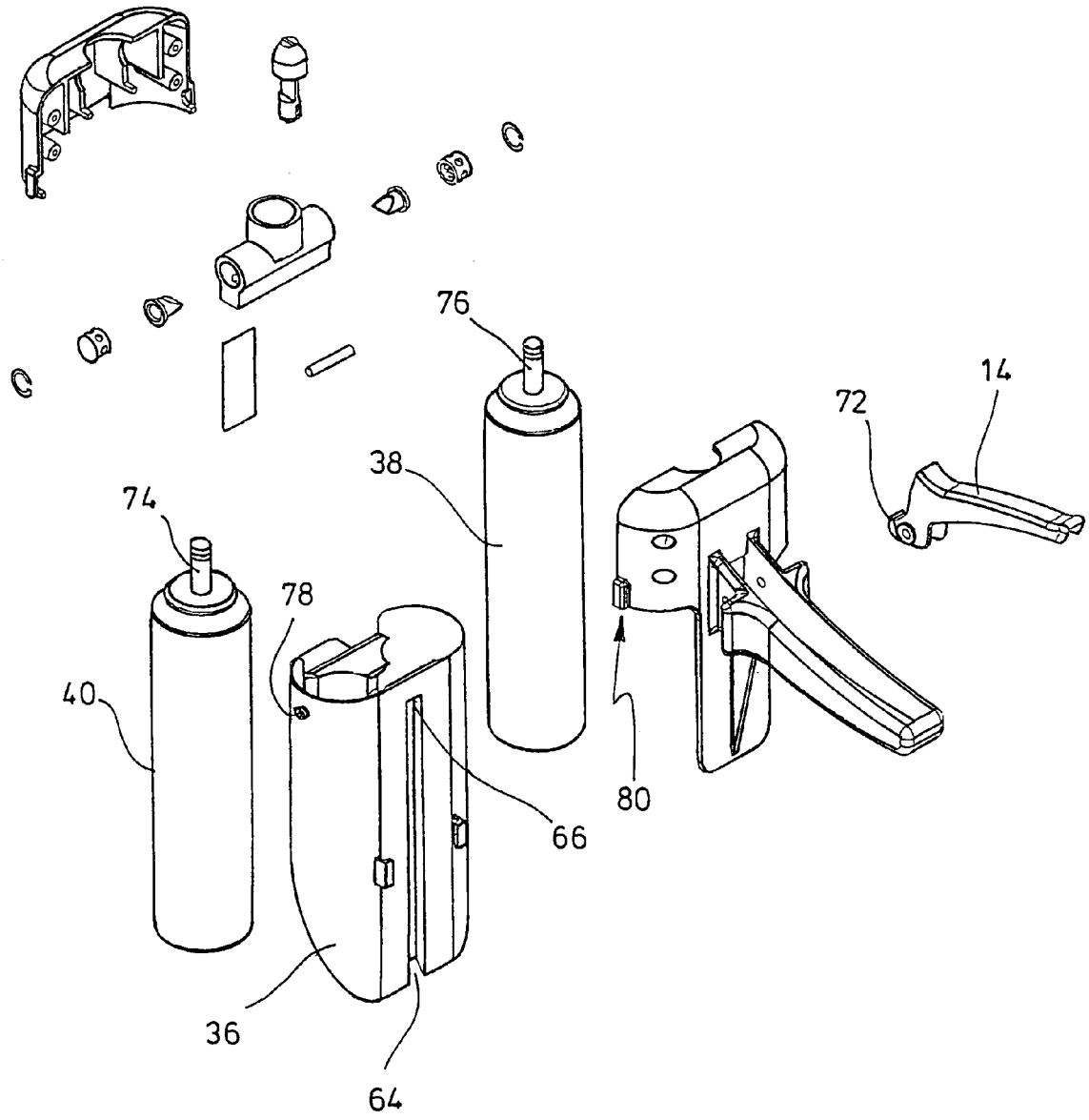
FIG. 4 shows an exploded view of the blending gun of FIG. 1 as seen obliquely from bottom in a perspective view.
Figure 5:
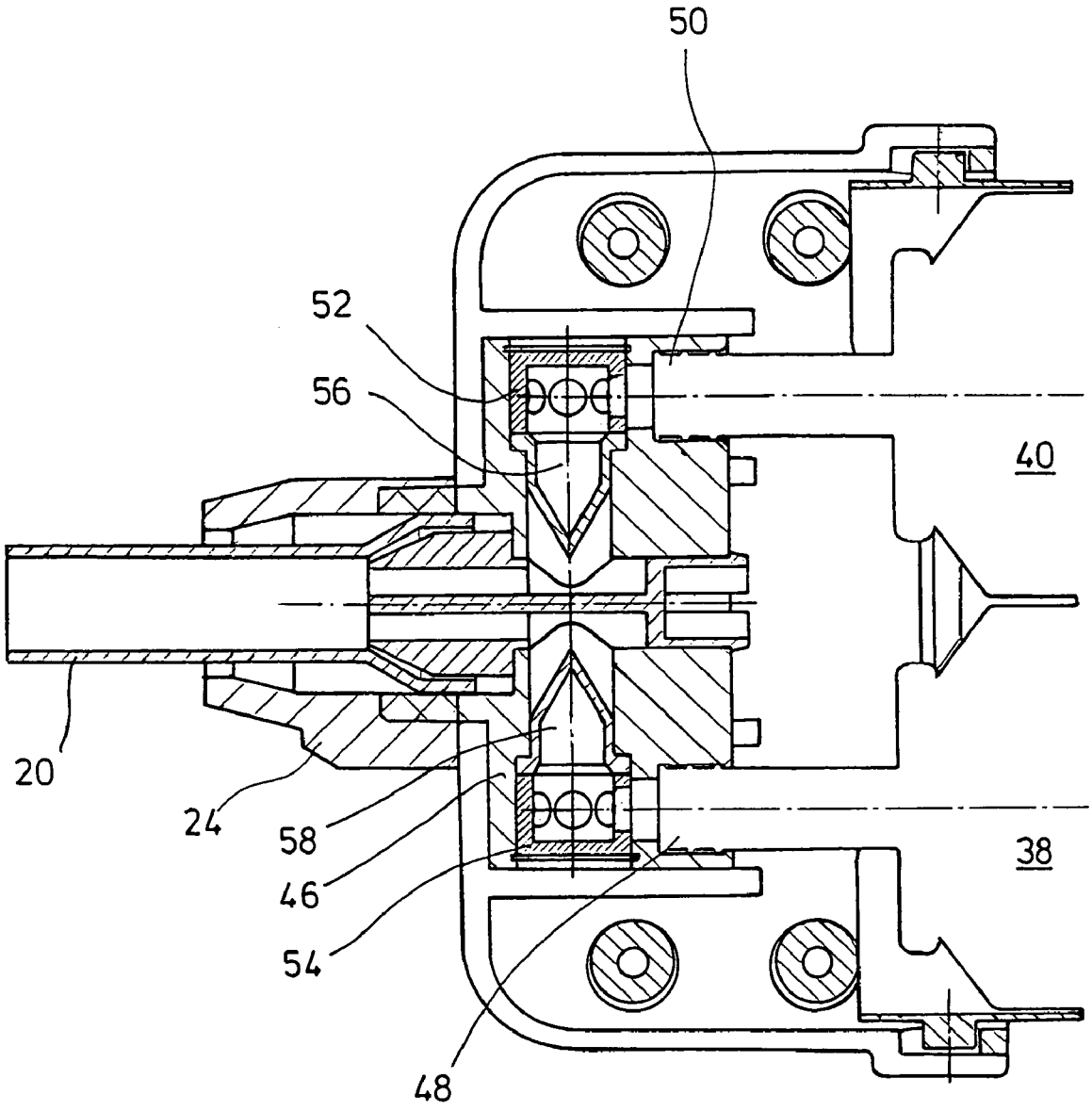
FIG. 5 shows a section through the connection means.

As is apparent from FIGS. 3 and 4 the head portion 28 has provided thereon connection means. The connection means illustrated comprises a blending body 46 which has two inlet openings 48, 50 for the valves of the vessels 38 and 40. As will be explained now the components are blended in the mixer only and not yet in the blending body. The components are fed to the mixer separately through the blending body. The inlet openings point towards the blending tube 20. The inlet channel 52 and 54 that respectively joins the inlet opening 48 and 50 has a check valve 56 and 58. The check valves 56 and 58 are introduced into the blending body through a lateral opening to facilitate their assembly. The check valves concerned are conically converging membrane elements which have a slot which is opened by the medium in the direction of channel and is squeezed in the opposite direction.

Centrally interposed between channels 52 and 54 is a channel body 60 which defines an extension of the two channels 52 and 54 towards the mixer. The inserted body 60 has a partition 62 which extends through the channel. For example, the inserted body 60 may be held by lugs on that side of the blending body 46 which faces away from the mixer.

The channel body 60 also serves as a gate for the mixer 20.

As can be seen distinctly in FIG. 4 the vessel receptacle 36 has a groove 64 at its underside that opens into an abutting surface 66 at the side facing the mixer. The actuation lever 14 has a bore 70 through which the actuation lever 14 is pivotally supported by a spigot 68 about the handle 12. A projection 72 extends into the holder and bears on the abutting surface 66. Actuating the lever 14 causes the receptacle 36 to be moved towards the mixer via the projection 72 and abutting surface 66. As a result, the projecting stem of the valves 74 and 78 urges the vessels 38 and 40 into the receptacles 48 and 50. The valves of the vessels 38 and 40 will open after a sufficient lift and the components will exit and get into the mixer 20.

For guidance of the receptacle on the holder device the latter is laterally provided with lugs 78 which are guided in an appropriate seat 80 on the head portion 28.

Not illustrated is a second catch plate which substantially corresponds in geometry to that of the catch plate 42 and is disposed opposite this one in the vessel receptacle 36. This enables the dispensing vessels 38 and 40 to be held in the vessel receptacle 36 for an application of an appropriate force. To prevent the catch plate 42 from coming off incidentally it can be biased to its engaged position via a leaf spring 80. The leaf spring 80 is guided on the receptacle 36 via tracks 82 and 84.

In the embodiment which is shown, force is applied by the actuation lever directly to the vessel receptacle for the dispensing vessels. An intensification of the force would also become possible by providing a transmission or gearing here.

The 2-component blending gun is preferably manufactured from a reinforced plastic and is designed for permanent use. The lift to be provided is different, depending on the valve used. As a rule, a lift of two to three millimeters is adequate for standard valves. Tilting valves may be employed in addition to the axially actuated valves which are shown. The design of the valves may vary as well and, thus, it is also possible to use so-called bag-on valves or valves having an internal pressure-guided piston.

Figure 6:
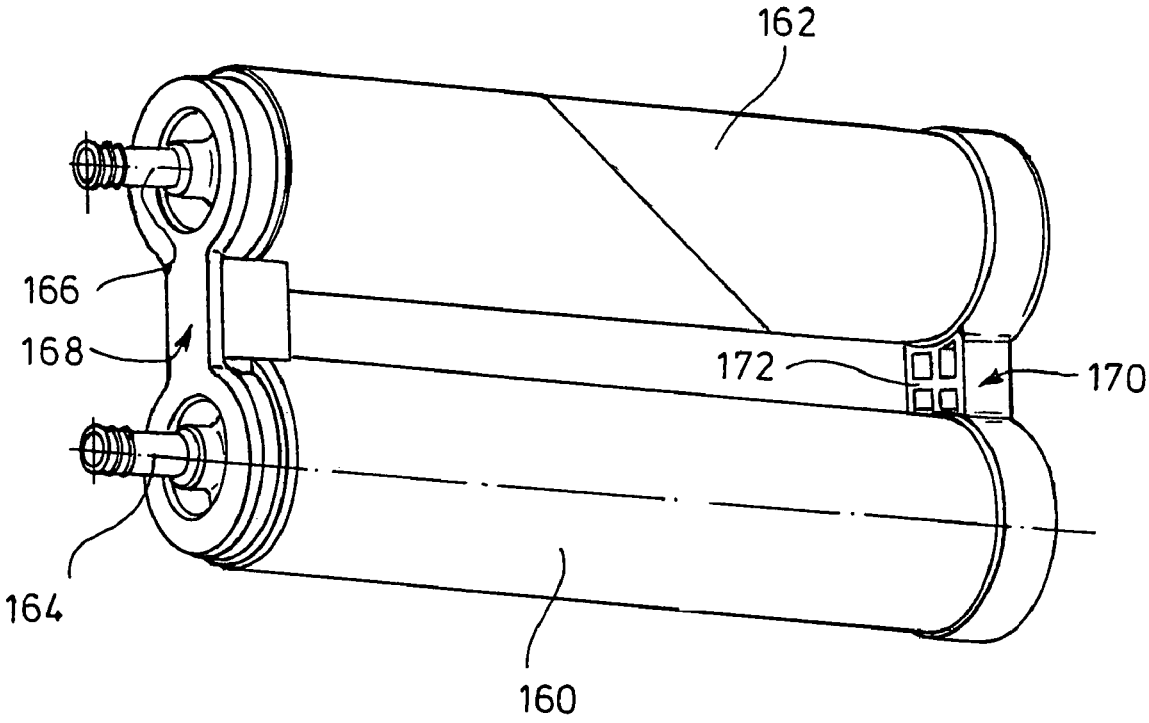
FIGS. 6 and 7 show two perspective views of vessel attachments for the bottom and top regions of the vessels.
Figure 7:
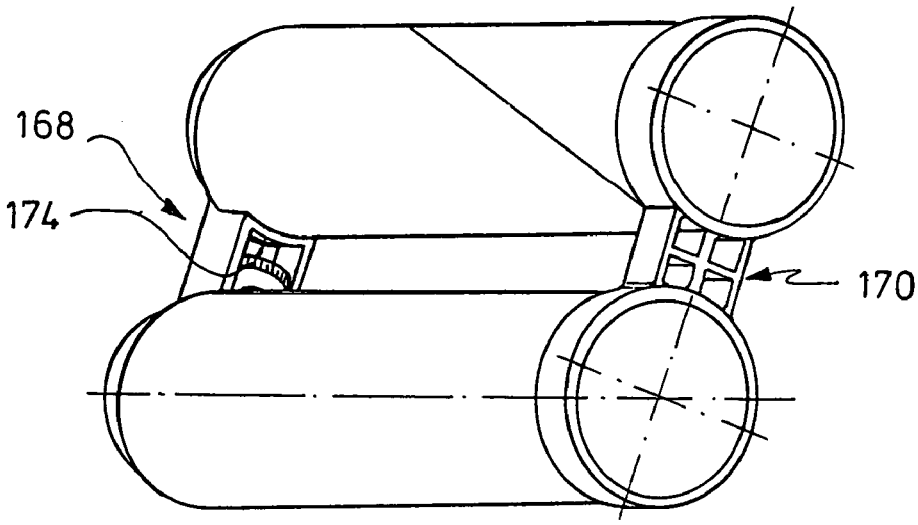

FIG. 6 shows two can-shaped vessels 160 and 162 each of which has a projecting stem 164, 166. For example, the valve interacting with the stem may be a valve as is used for PU foam. The vessels 160 and 162 are held in parallel and at the same orientation to each other by means of a pair of vessel attachments 168 and 170. Each vessel attachment is of an roughly bone-like shape with one receptacle each for the vessel. The substantially circular receptacles for the vessel ends are joined to each other via a bridging portion. The bridging portions have cruciform webs 172, 174. The vessel attachment 168 provided in the top region of the vessels has an abutting surface which is provided on the side facing away from the valves and is for an actuation device. This abutting surface can suitably be located approximately at the level of the longitudinal axis of the vessels 160, 162 so that this avoids tilting the vessels while they are advanced.

It is preferred to use a snap-in mechanism to join the vessel attachments 160 and 170 to the vessels 160 and 162. The vessel attachments are renewed together with the vessels in case of a replacement. The risk of confusing them may be ruled out by providing appropriate contours to the vessel attachments and the holder.

As was the case for the vessel receptacle 136 already the vessel attachment 168 is slidably guided in the head portion 128 of the holder, which makes the vessel receptacle 136 unnecessary here.

In this aspect, a spring-loaded release lever may be provided which grips behind the bridging portion. This also secures the inserted vessels from being taken out. For a detachment of the vessels with the vessel attachment, a solvent is provided which loosens the vessel attachment in the head portion of the holder so that the vessel attachment can be removed.

In a possible aspect, the two dispensing vessels are interconnected to form a package already. An appropriate geometry of this package allows a suitable receptacle or appropriate blending body to prevent a confused introduction of the vessels. Dispensing vessels can be provided in different volumes and with different valves, depending on the desired blending ratio. If dispensing vessels having a rolled rim are used the detent means preferably grip behind the rim.

Figure 9:
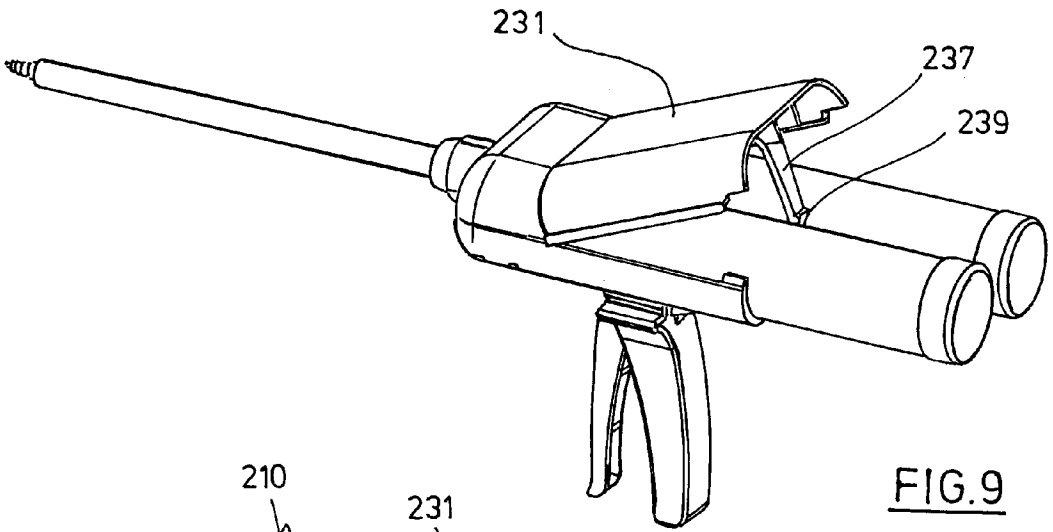
FIGS. 8 and 9 show an alternative aspect in a perspective view.
Figure 8:
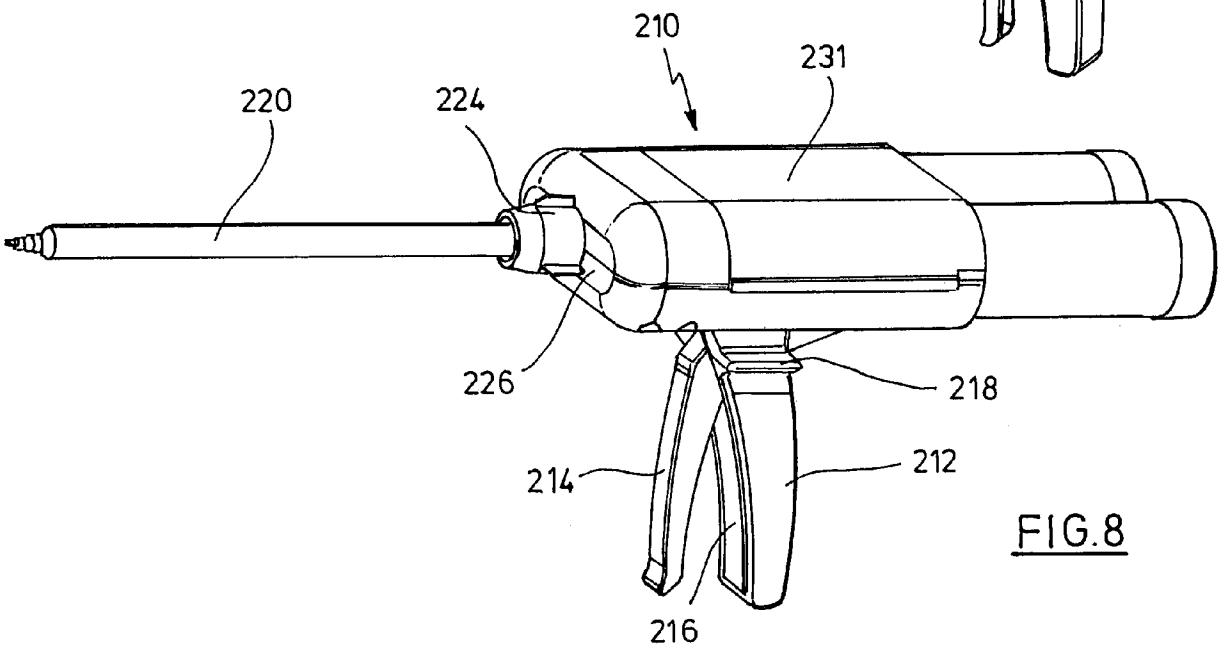

An alternative aspect of a two-component blending gun 210 is shown in FIGS. 8 and 9. Like the model described previously, the blending gun has a handle 212 with a receptacle 216 for an actuation lever 214. Again, a lug 18 is provided as an abutment for the thumb. Like in the model which is known already, the mixer 220 is fixed to a holder 226 by means of a spigot nut 224.

Figure 10:
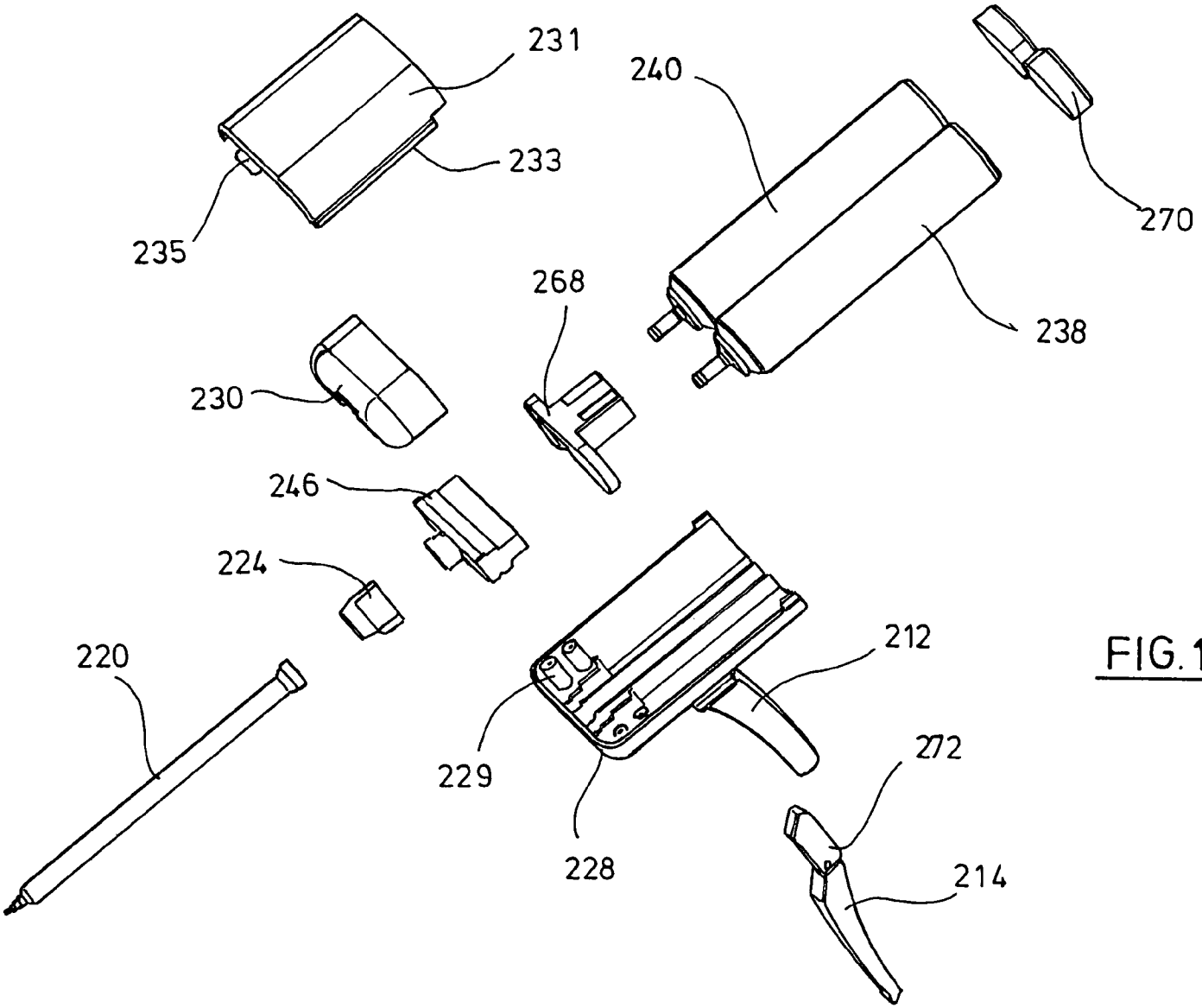
FIG. 10 shows an exploded view of the blending gun of FIG. 8.

As can be seen from FIG. 10 the holder 226 is composed of a lower shell half 228 and an upper shell half 230. The lower shell half 228 is joined to the handle 212 and, at the side facing the handle, has an opening through which a projection 272 of the actuation lever 214 extends into the interior. The upper shell half 230 may be fixed, along with the lower shell half 228, by means of two pairs of screws which are guided in the lower shell half 228 via screw channels 229.

In addition to the upper shell half 230, a cover element 231 is provided which engages both the upper shell half 230 and lower shell half 228 via lateral detent edges 233 and a detent projection 235. At its rear end, the cover 231 centrally has a projection 237 with a catch nose 239. The projection 237 is passed through between the vessels 238 and 240 and additionally secures the cover element 231 to the lower shell half 228.

The two vessels 238 and 240 are accommodated in a pair of vessel attachments 268 and 270. The vessel's front attachment 268 is joined to either of the two vessels 238 and 240. The vessel attachment 268 has an annular indentation with detent means which snap into a circumferential lug along the valve disk. At its underside, the vessel adapter 268 has a recess into which the projection 272 of the actuation lever 214 extends. During use, the actuation lever 214 is depressed and the force applied is transmitted to the upper vessel adapter. The vessels 238 and 240, along with the lower vessel attachment 270, are thus moved towards the mixer 220.

The projecting stem of the valves extends through the vessel attachment 268 and into a blending body 246 which serves as a gate to the mixer. The components being mixed are separately fed to the mixer through the blending body.

Figure 11:
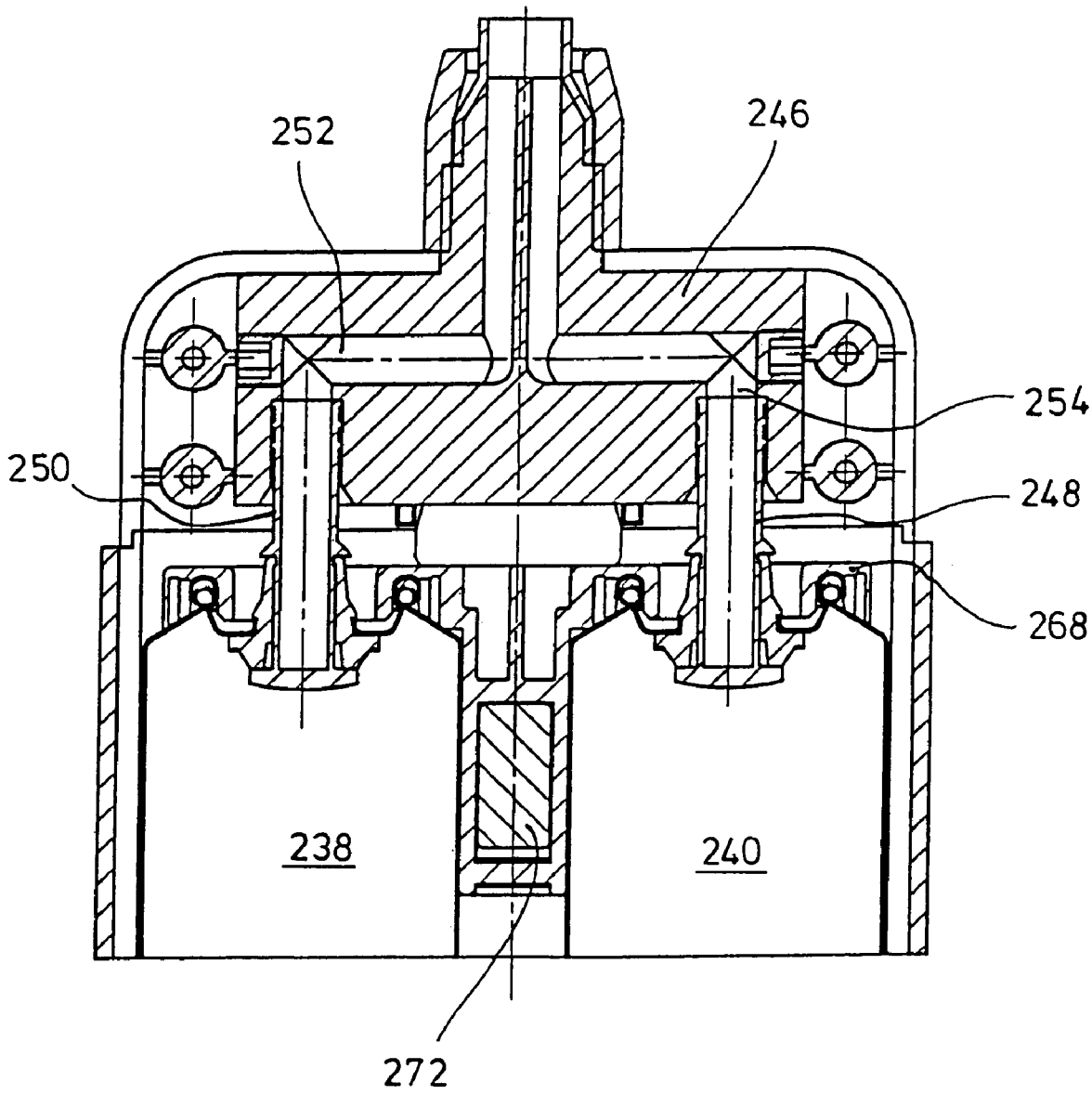
FIG. 11 shows a section through the connection means for the blending gun of FIG. 8.

FIG. 11 shows a cross-section through the front portion of the blending gun. The blending body 246 has two separate channels 252 and 254. The stems 248 and 250 are mounted in the blending body 246. So-called tilting valves which will also open when under an axial pressure are shown as valves in FIG. 11.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. An apparatus fox blending two different components, comprising: two vessels (38, 40) each containing one of said components, connection means (46, 48) to which said components are separately fed from each of said vessels (38, 40), and an actuation device (14, 72) which initiates the entry of the components into said connection means from said vessels at a predetermined ratio, characterized in that each of said two vessels (38, 40) is provided as a pressurized vessel (38, 40) from which said component is discharged by means of an expulsion medium via a valve, the valves of said vessels being operated via the actuation device (14, 72), wherein said connection means comprise a blending body (46) including two inlet openings and two channels, and a channel body (60) having a partition (62) defining said two channels, and a check valve (56, 58) being provided in either channel to prevent the components from flowing back to said vessels, said channel body being inserted into said blending body.

2. The apparatus according to claim 1, characterized in that said vessels (38, 40) are configured as dispensing vessels in a roughly cylindrical shape.

3. The apparatus according to claim 2, characterized in that said dispensing vessels (38, 40) are arranged as a package parallel to each other.

4. The apparatus according to claim 2, characterized in that said vessels are provided with a valve at their fronts.

5. The apparatus according to claim 4, characterized in that at least one of said vessels has a male valve which opens when a pressure acts on its projecting stem in an axial direction and/or which opens when its projecting stem is tilted crosswise to the axial direction.

6. The apparatus according to claim 4, characterized in that at least one of said vessels has a female valve which opens when it is pressed in an axial direction.

7. The apparatus according to claim 1, characterized in that said connection means have a blending tip in which said components undergo thorough blending.

8. The apparatus according to claim 7, characterized in that said blending tip is placed on top of said blending body.

9. The apparatus according to claim 1, characterized in that a pair of vessel attachments are provided each of which defines a receptacle for the vessel body.

10. The apparatus according to claim 9, characterized in that at least one of said vessel attachments, in the area of the receptacle, has a through opening through which the valve is accessible.

11. The apparatus according to claim 9, characterized in that said vessel attachments have catch lugs which grip behind projections on said vessels.

12. The apparatus according to claims 9, characterized in that said vessel attachment for the head portion of said vessels has an abutting surface for an interaction with the actuation device.

13. The apparatus according to claim 1, characterized in that a holder is provided to releasably connect to said vessels.

14. The apparatus according to claim 13, characterized in that said holder has a handle (12) and an actuation lever (14).

15. The apparatus according to claim 14, characterized in that said actuation lever (14) is hinged to said holder and has a projection (72) which interacts with said vessel.

16. The apparatus according to claim 15, characterized in that said reception sleeve (36) has an abutting surface which interacts with said actuation device.

17. The apparatus according to claim 13, characterized in that said holder has a head portion (26, 28) in which said connection means are disposed.

18. The apparatus according to claim 17, characterized in that said vessels are releasably held in a reception sleeve (36).

19. The apparatus according to claim 18, characterized in that said reception sleeve is slidably arranged in said head portions of said holder where a displacement is performed via said actuation device and said valves of said vessels are opened in the advanced position.

20. The apparatus according to claim 18, characterized in that said reception sleeve (36) has detent means which grip behind a projection of said vessel.

21. The apparatus according to claim 20, characterized in that said detent means have at least one catch plate including two indentations.

22. The apparatus according to claim 21, characterized in that said detent means have a lever (44) to disengage said catch plate from its engaged position.

* * * * *